US011105233B2

(12) United States Patent
Kass et al.

(10) Patent No.: US 11,105,233 B2
(45) Date of Patent: Aug. 31, 2021

(54) SYSTEMS AND METHODS FOR REGULATING PERFORMANCE CHARACTERISTICS OF AN EXHAUST SYSTEM WITH A TRI-MODAL VALVE

(71) Applicant: TOYOTA MOTOR NORTH AMERICA, INC., Plano, TX (US)

(72) Inventors: Tyler J. Kass, Ponder, TX (US); Stephen E. Freeman, McKinney, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 45 days.

(21) Appl. No.: 16/262,523

(22) Filed: Jan. 30, 2019

(65) Prior Publication Data

US 2020/0240301 A1 Jul. 30, 2020

(51) Int. Cl.

| | |
|---|---|
| ***F01N 1/16*** | (2006.01) |
| ***F01N 3/24*** | (2006.01) |
| ***F01N 13/08*** | (2010.01) |

(52) U.S. Cl.

CPC ..... *F01N 1/165* (2013.01); *F01N 3/24* (2013.01); *F01N 13/082* (2013.01); *F01N 2390/00* (2013.01); *F01N 2470/00* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,750,459 | A | 6/1988 | Schmidt | |
| 5,355,673 | A | 10/1994 | Sterling et al. | |
| 5,372,109 | A | 12/1994 | Thompson et al. | |
| 6,109,027 | A * | 8/2000 | Schaefer | F02D 9/04 123/323 |
| 6,179,096 | B1 * | 1/2001 | Kinerson | F01N 13/10 123/323 |
| 6,321,533 | B1 * | 11/2001 | Watanabe | B01D 53/0454 60/274 |
| 6,425,412 | B2 | 7/2002 | Sterling | |
| 7,275,367 | B2 * | 10/2007 | Tamura | F01N 3/2006 137/599.01 |
| 7,536,990 | B2 | 5/2009 | Willats et al. | |

(Continued)

FOREIGN PATENT DOCUMENTS

| | | | |
|---|---|---|---|
| EP | 2693011 | A1 | 2/2014 |
| JP | 2007205183 | A | 8/2007 |

*Primary Examiner* — Binh Q Tran

(74) *Attorney, Agent, or Firm* — Haynes and Boone, LLP

(57) ABSTRACT

A system for regulating performance characteristics of a vehicle includes an engine configured to output an exhaust gas. The system further comprises an emissions system in fluid communication with the engine, the emissions system configured to clean the exhaust gas. The system further comprises a valve system in fluid communication with the emissions system, the valve system configured to regulate a flow of the exhaust gas. The valve system comprises a vane movable between a forward open position, a closed position, and a rear open position. The valve system further comprises a biasing member configured to bias the vane in the forward open position. The valve system further comprises a bypass channel configured to provide a bypass flow path for the exhaust gas to control a backpressure on the vane.

20 Claims, 6 Drawing Sheets

(56) References Cited

U.S. PATENT DOCUMENTS

| | | | | |
|---|---|---|---|---|
| 8,201,401 | B2 | 6/2012 | Abram et al. | |
| 8,763,384 | B2 | 7/2014 | Takagaki et al. | |
| 9,376,947 | B2 | 6/2016 | Abram et al. | |
| 9,540,995 | B2 | 1/2017 | Houtschilt et al. | |
| 9,657,652 | B2 | 5/2017 | Hossfeld et al. | |
| 2006/0260868 | A1 | 11/2006 | Suzuki et al. | |
| 2007/0107981 | A1 | 5/2007 | Sicotte | |
| 2008/0116404 | A1 | 5/2008 | Willats et al. | |
| 2008/0236680 | A1 | 10/2008 | Abram et al. | |
| 2010/0192559 | A1 | 8/2010 | Abram et al. | |
| 2011/0179770 | A1 | 7/2011 | Schmuck-Soldan | |
| 2011/0225955 | A1* | 9/2011 | Kimura | F02M 26/35 60/278 |
| 2012/0102934 | A1* | 5/2012 | Magnetto | F02M 26/28 60/320 |
| 2013/0213731 | A1 | 8/2013 | Abram et al. | |
| 2015/0275739 | A1* | 10/2015 | Ishihata | F01N 5/02 60/324 |
| 2016/0376970 | A1* | 12/2016 | Murata | F01N 5/02 60/320 |
| 2018/0128145 | A1 | 5/2018 | Uhrich et al. | |

* cited by examiner

SYSTEMS AND METHODS FOR REGULATING PERFORMANCE CHARACTERISTICS OF AN EXHAUST SYSTEM WITH A TRI-MODAL VALVE

TECHNICAL FIELD

The present disclosure relates generally to regulating the performance of an exhaust system and, more particularly, to regulating the performance of an exhaust system in a combustion engine using a tri-modal valve.

BACKGROUND

The ability of a vehicle exhaust system to provide sports characteristics at low and high engine speeds and also provide low cabin noise at cruising speeds is limited. A more reliable, cost-effective method is needed to regulate performance characteristics of an exhaust system. The ability of an exhaust system to provide sports characteristics (which may include loud exhaust discharges and/or exhaust pulses) at low and high engine speeds may allow for the provision of acoustically-appealing vehicle characteristics for a wide range of consumers. Further, such exhaust systems that also provide a decreased acoustic output at cruising speeds increase the comfort and enjoyment levels of drivers and passengers alike by allowing the vehicle occupants to converse with each other without unnecessary strain or effort. Existing exhaust systems include bi-modal valves and lack the ability to achieve a third mode of operation. This lacks acoustic refinement and can lead to an overly noisy ride and/or a lack of sports exhaust characteristics at low engine speeds. It would therefore be desirable to enable an exhaust system to accurately, repeatably, and reliably regulate performance characteristics, such as acoustic characteristics, for example, using a single valve. Therefore, what is needed is an apparatus, system, and/or method that addresses one or more of the foregoing issues, and/or one or more other issues.

SUMMARY

The present disclosure provides systems and methods for regulating performance characteristics of a vehicle (e.g., an acoustic output of an exhaust pulse) using an exhaust system with a tri-modal valve. A generalized system for regulating performance characteristics of a vehicle includes an engine configured to output an exhaust gas. The system further includes an emissions system in fluid communication with the engine, and the emissions system is configured to clean the exhaust gas. The system further includes a valve system in fluid communication with the emissions system. The valve system is configured to regulate a flow of the exhaust gas. The valve system includes a vane movable between a forward open position, a closed position, and a rear open position. The valve system further includes a biasing member configured to bias the vane in the forward open position. The valve system further includes a bypass channel configured to provide a bypass flow path for the exhaust gas to control a backpressure on the vane.

An additional generalized system for regulating performance characteristics of a vehicle includes an engine. The system further includes an emissions system. The system further includes a valve system configured to regulate a flow of an exhaust gas. The valve system includes a vane movable between: (1) a forward open position to provide low restriction of the flow of the exhaust gas as the exhaust gas flows through the valve system; (2) a closed position to provide high restriction of the flow of the exhaust gas as the exhaust gas flows through the valve system; and (3) a rear open position to provide low restriction of the flow of the exhaust gas as the exhaust gas flows through the valve system. The valve system further includes a biasing member configured to bias the vane in the forward open position. The valve system further includes a bypass channel configured to provide a bypass flow path for the exhaust gas to control a backpressure on the vane.

A generalized method for regulating performance characteristics of a vehicle includes biasing a vane of a valve system in a forward open position to provide low restriction of a flow of an exhaust gas. The method further includes moving, in response to a first increase in the flow of the exhaust gas, the vane from the forward open position to a closed position to provide high restriction of the flow of the exhaust gas. The method further includes maintaining the vane in the closed position in response to the flow of the exhaust gas flowing through a bypass channel. The method further includes moving, in response to a second increase in the flow of the exhaust gas, the vane from the closed position to a rear open position to provide low restriction of the flow of the exhaust gas.

DETAILED DESCRIPTION

Figure 1:
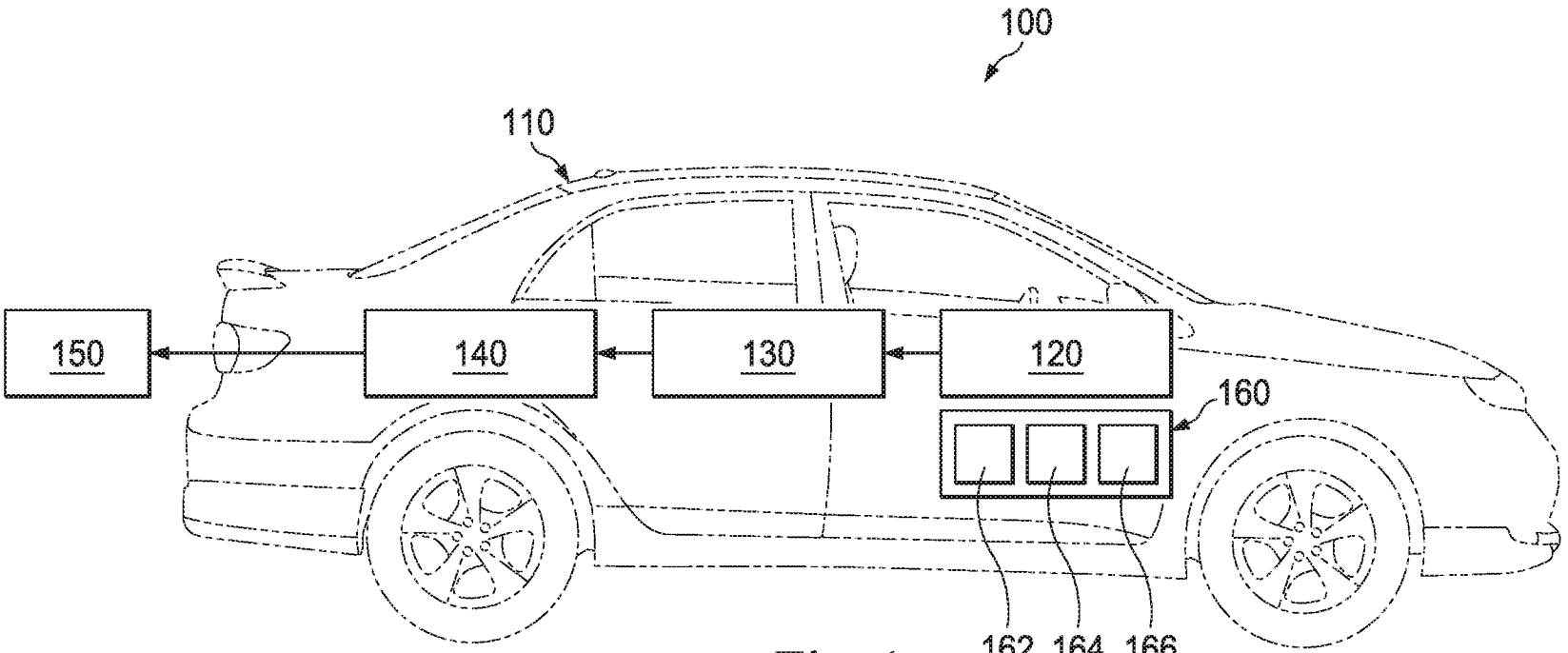
FIG. 1 is a diagrammatic illustration of a system for regulating performance characteristics of a vehicle according to one or more embodiments of the present disclosure.

For the purposes of promoting an understanding of the principles of the invention, reference will now be made to certain implementations, or examples, illustrated in the drawings, and specific language will be used to describe the same. It will nevertheless be understood that no limitation of the scope of the invention is thereby intended. Any alterations and further modifications in the described implementations, and any further applications of the principles of the invention as described herein are contemplated as would normally occur to one skilled in the art to which the invention relates.

This disclosure describes a system for regulating performance characteristics of a vehicle. In the system, a valve system in the vehicle regulates a flow of exhaust gas as the exhaust gas flows from the engine, to an exhaust output, and into the atmosphere. The valve system includes a vane in an exhaust channel, and the vane is movable between at least three positions: a forward open position, a closed position, and a rear open position. Additionally, the valve system includes a bypass channel that provides an additional flow path for the exhaust gas. When the vane is in the forward open position, there may be low to no restriction of the flow of the exhaust gas through the exhaust channel. Therefore, a noise level of an exhaust discharge may be loud, which may be preferred by vehicle owners that want a vehicle with sports exhaust characteristics. Additionally, when the vane is in the forward open position, the vehicle may be idling or in an overrun state. When the vane is in the closed position, there may be generally complete restriction of the flow of the exhaust gas through the exhaust channel. Therefore, the bypass channel becomes the primary flow path for the exhaust gas, which prevents the vane from travelling immediately from the forward open position to the rear open position. Additionally, a noise level of an exhaust discharge may be quiet (or at least quieter than the noise level when the vane is in the forward open position), which may allow occupants of the vehicle to easily converse with one another. Further, when the vane is in the closed position, the vehicle may be in a cruising state. When the vane is in the rear open position, there may be generally no restriction of the flow of the exhaust gas through the exhaust channel. Therefore, a noise level of an exhaust discharge may be loud (and may be louder than the noise level when the vane is in the forward open position). Additionally, when the vane is in the rear open position, the vehicle may be moderately or fully accelerating.

FIG. 1 is a diagrammatic illustration of a system for regulating performance characteristics of a vehicle according to one or more embodiments of the present disclosure. In at least one such embodiment, as illustrated in FIG. 1, the system is generally referred to by the reference numeral 100 and includes a vehicle 110. In the embodiment of FIG. 1, the vehicle 110 includes an engine 120, at least one catalyzing element 130, a valve system 140 (which may be a tri-modal valve system), and an exhaust output 150. In the embodiment of FIG. 1, the vehicle 110 is an automobile. While in FIG. 1 the vehicle 110 is depicted as a car, it is to be understood that the vehicle 110 may be any other type of suitable automobile (e.g., a pickup truck, a semi truck, a fleet vehicle, etc.). The vehicle 110 includes a human-machine interface (HMI) 160 (which may be a user interface).

The HMI 160, includes a display unit 162, an input/output (I/O) device 164, and a communication device 166, which may be a Bluetooth or other wireless or wired device. The I/O device 164 may be in the form of a communication port (e.g., a USB port), a touch-screen display unit, soft keys associated with a dashboard, a steering wheel, and/or other similar components of the vehicle 110. The display unit 162 may be, include, or be part of a plurality of display units arranged to show a visual output to a user. For example, in several embodiments, the display unit 162 may include one, or any combination, of a central display unit associated with the dashboard of the vehicle 110, an instrument cluster display unit associated with an instrument cluster of the vehicle 110, and a heads-up display unit associated with the dashboard and a windshield of the vehicle 110. Thus, as used herein the reference numeral 162 may refer to one, or a combination, of said display units.

Figure 2A:
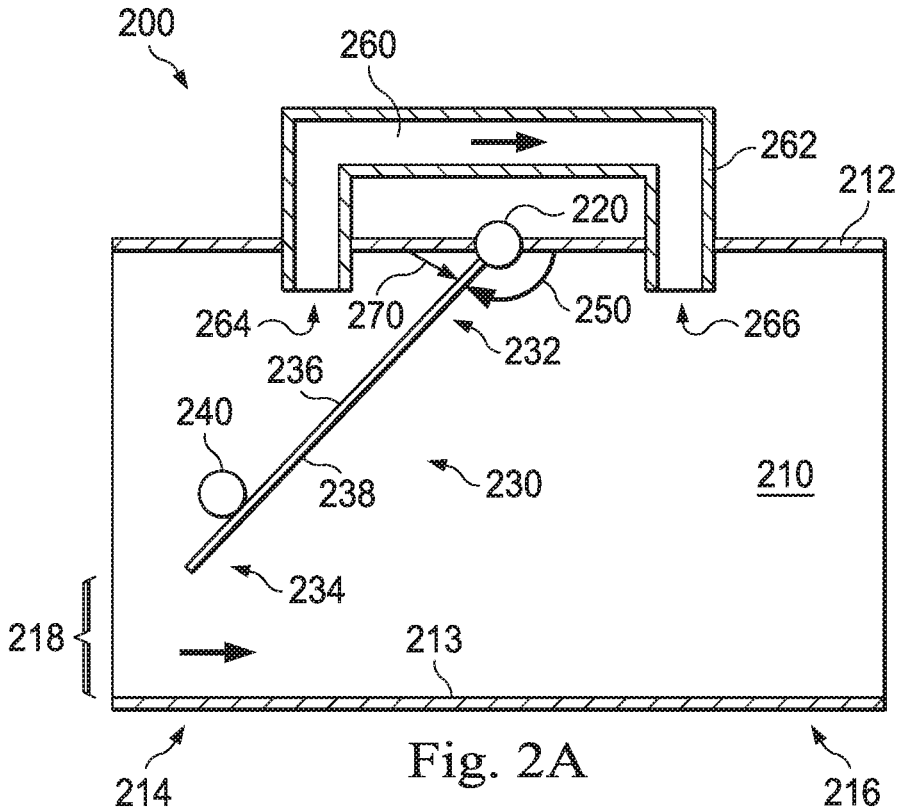
FIG. 2A is a diagrammatic illustration of a system with a vane in a forward open position according to one or more embodiments of the present disclosure.

FIG. 2A is a diagrammatic illustration of a system with a vane in a forward open position according to one or more embodiments of the present disclosure. In at least one such embodiment, as illustrated in FIG. 2A, the system is a valve system 200, which may represent the valve system 140 in FIG. 1. In the embodiment shown in FIG. 2A, the valve system 200 includes an exhaust channel 210, which may be an exhaust pipe. The exhaust channel 210 includes a wall 212, an upstream side 214, and a downstream side 216. The exhaust channel 210 may by a cylindrical channel, a rectangular channel, or a channel of any other geometry that may be needed to fit the exhaust channel 210 within the vehicle 110. In some embodiments, exhaust gas may flow from the engine 120, through the catalyzing elements 130, through the valve system 200 (and more specifically, through the exhaust channel 210), and then may be output to the atmosphere after exiting the vehicle 110 through the exhaust output 150. When the exhaust gas flows through the exhaust channel 210, the exhaust gas flows from the upstream side 214 of the exhaust channel 210 to the downstream side 216 of the exhaust channel 210. As shown in FIG. 2A, the valve system 200 further includes a pivot 220 (which may be a pivot member) coupled to the wall 212 of the exhaust channel 210, a vane 230, a stopping member 240, a biasing member 250, and a bypass channel 260, which may be a bypass pipe. In some embodiments, the biasing member 250 may be a spring, a hydraulic actuator, a pneumatic actuator, or any other suitable component. The bypass channel 260 may provide a bypass flow path for the exhaust gas.

In the embodiment of FIG. 2A, the bypass channel 260 is an exterior bypass channel. As shown in FIG. 2A, the bypass channel 260 includes an inlet port 264 and an outlet port 266. In some examples, the inlet port 264 is in fluid communication with the exhaust channel 210 on an upstream side of the vane 230 (e.g., the upstream side 214 of the exhaust channel 210), and the outlet port 266 is in fluid communication with the exhaust channel 210 on a downstream side of the vane 230 (e.g., the downstream side 216 of the exhaust channel 210). The bypass channel 260 includes a wall 262, and the bypass channel 260 may by a cylindrical channel, a rectangular channel, or a channel of any other geometry that may be needed to fit the bypass channel 260 within the valve system 200 and the vehicle 110. The vane 230 includes a proximal portion 232 and a distal portion 234. In the embodiment shown in FIG. 2A, the proximal portion 232 of the vane 230 is coupled to the pivot 220 so that as the pivot 220 rotates, the vane 230 may rotate as well.

In several embodiments, the vane 230 may be rotatable between a plurality of positions (e.g., one, two, three, or any other number of positions). In some embodiments, the vane 230 may rotate smoothly and continuously between the plurality of positions. In other embodiments, the vane 230 may rotate in a more erratic fashion depending on the backpressure applied to the upstream surface 236 of the vane 230. In an exemplary embodiment, the vane 230 may be rotatable between a first position, a second position, and a third position. In the first position, which may be a forward open position, the biasing member 250 may bias the vane 230 so that the distal portion 234 of the vane 230 rests against the stopping member 240. In the embodiment shown in FIG. 2A, the vane 230 is in the forward open position. As shown in FIG. 2A, the stopping member 240 is upstream of the pivot 220 in the flow path of the exhaust gas through the exhaust channel 210. Accordingly, in the forward open position, the distal portion 234 of the vane 230 is upstream of the proximal portion 232 of the vane 230 and, therefore, upstream of the pivot 220. Additionally, in the embodiment shown in FIG. 2A, when the vane 230 is in the forward open position, the distal portion 234 of the vane 230 is spaced from a bottom surface 213 of the wall 212 of the exhaust channel 210.

In several embodiments, as the exhaust gas flows through the exhaust channel 210, a backpressure is placed on an upstream surface 236 of the vane 230. The backpressure may be illustrated by the indicator 270. In exemplary embodiments, when the vane 230 is in the forward open position, a force (which may be a biasing force) placed on a downstream surface 238 of the vane 230 by the biasing member 250 is greater than the backpressure placed on the upstream surface 236 of the vane 230. The vane 230 may be in the forward open position when a load on the engine 120 is low and/or when the vehicle 110 is in an idle state (e.g., when a speed of the engine 120 is low). In the forward open position, the exhaust gas may flow through both a lower portion 218 of the exhaust channel 210, beneath the vane 230, and through the bypass channel 260 (which may be a bypass flow of the exhaust gas). Accordingly, in some embodiments, there is relatively low restriction of the flow of the exhaust gas through the valve system 200 when the vane 230 is in the forward open position. In other embodiments, there is no restriction of the flow of the exhaust gas through the valve system 200 when the vane 230 is in the forward open position. As the flow of the exhaust gas increases, the vane 230 is moved toward a closed position, and more exhaust gas begins to flow through the bypass channel 260, which will be discussed in further detail below.

In several examples, when there is relatively low or no restriction of the flow of the exhaust gas through the exhaust channel 210, a noise level (which may be an acoustic output) of an exhaust discharge (which may be exhaust gas flowing through the exhaust output 150) may be loud. For example, the noise level may be loud when the engine 120 of the vehicle 110 is running, but gas pedal of the vehicle 110 is not being pressed. In some embodiments, the exhaust gas is output in the form of an exhaust pulse. An exhaust pulse may occur when a driver of the vehicle 110 repeatably presses down on a gas pedal of the vehicle 110. The driver of the vehicle 110 may repeatably press down on the gas pedal of the vehicle 110 to rev the engine while the vehicle 110 is idling, for example. The loud noise level may be preferable for a driver of the vehicle 110 who wants the exhaust system of the vehicle 110 to exhibit the characteristics of a sports exhaust when the vehicle 110 is idling, for example. Therefore, in some examples, the valve system 140 may facilitate sports exhaust characteristics when the vehicle 110 is idling or when the engine 120 in an overrun state. The engine 120 may be in an overrun state when the vehicle 110 is moving, but the vehicle 110 is not accelerating (which may occur when the driver does not press down on the gas pedal). For example, the vehicle 110 may be in an overrun state when the vehicle 110 is coasting (e.g., to slow down without braking, when travelling down a hill, etc.).

In several embodiments, the bypass channel 260 may be tuned to provide a variety of desired characteristics, which may depend on a driver's desired performance characteristics for the vehicle 110 or the proper characteristics for peak performance of the systems of the vehicle 110. For example, the bypass channel 260 may be tuned to provide different performance characteristics for an emissions system, an exhaust system, an acoustic output from the vehicle 110, etc. In some instances, the vehicle 110 may be tuned by adjusting the biasing member 250 and/or by adjusting any other component in the vehicle 110 to achieve a desired performance characteristic(s). In some embodiments, tuning of the vehicle 110 may be performed to set the peak restriction of the flow of the exhaust gas through the valve system 140 relative to the load on the engine 120 at a desired or optimum value. In several embodiments, as the flow through the bypass channel 260 increases, the pressure across the bypass channel 260 begins to approach a saturated flow range. In some examples, in the saturated flow range, an increase in pressure across the bypass channel 260 does not produce a corresponding increase in flow. As the pressure across the bypass channel 260 increases, the backpressure applied to the upstream surface 236 of the vane 230 also increases. As the backpressure applied to the upstream surface 236 of the vane 230 increases, the vane 230 and the pivot 220 begin to rotate in a counterclockwise direction, for example, such that the distal portion 234 of the vane 230 moves in a downstream direction.

In some embodiments, when the vane 230 is in the forward open position, the bypass channel 260 receives a flow of exhaust gas at a first pressure (which may be a first bypass pressure). As the engine load increases, which may occur as more fuel is supplied to the engine 120 (e.g., when a driver of the vehicle 110 presses down on a gas pedal of the vehicle 110), the flow of the exhaust gas through the exhaust channel 210 increases as well. This may result in an increase in pressure across the bypass channel 260. As discussed above, the increase in pressure across the exhaust channel 210 causes the backpressure applied to the upstream surface 236 of the vane 230 to increase. As discussed above, when the pressure across the bypass channel 260 reaches a saturated flow range, any increase in pressure across the bypass channel 260 will not produce a corresponding increase in exhaust gas flow through the bypass channel 260. In some embodiments, when a saturated flow is reached in the bypass channel 260, the backpressure in the exhaust channel 210 increases to such a level that the force applied to the upstream surface 236 of the vane 230 by the backpressure may equal or substantially equal the force applied to the downstream surface 238 of the vane 230 by the biasing member 250, as shown in the embodiment in FIG. 2B.

Figure 2B:
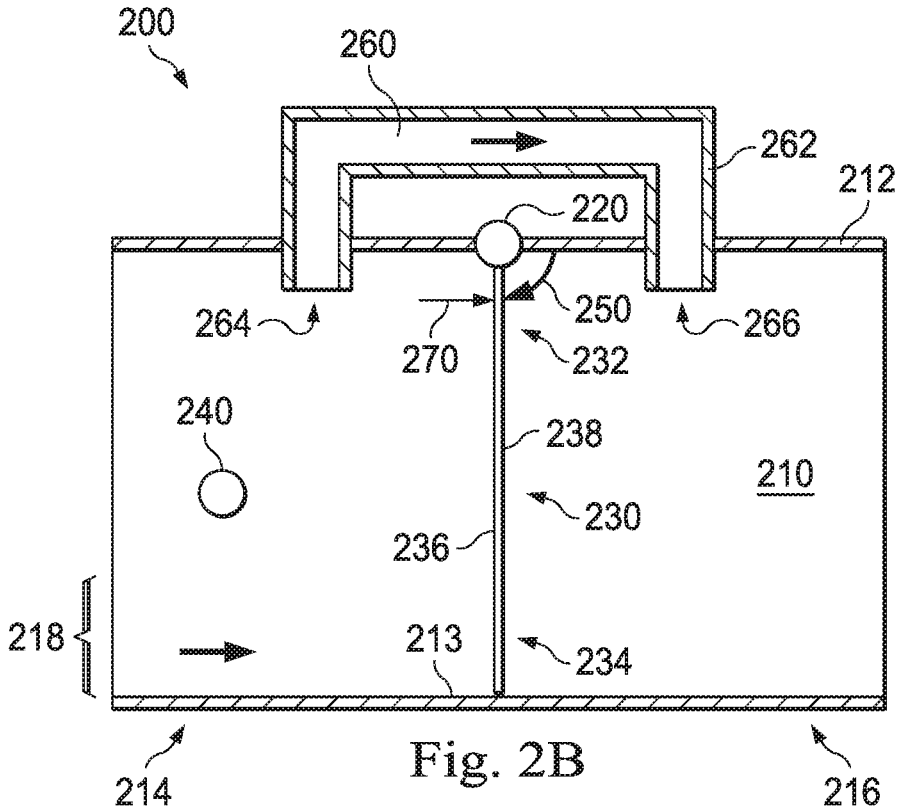
FIG. 2B is a diagrammatic illustration of a system with a vane in a closed position according to one or more embodiments of the present disclosure.

FIG. 2B is a diagrammatic illustration of the valve system 200 with the vane 230 in a closed position according to one or more embodiments of the present disclosure. As discussed above, in some embodiments, the vane 230 may be rotatable between a first position, a second position, and a third position. The embodiment of FIG. 2B illustrates the vane 230 in the second position, which may be a closed position. When the vane 230 is in the closed position, the biasing member 250 may bias the vane 230 so that the proximal portion 232 of the vane 230 and the distal portion 234 of the vane 230 are generally aligned in a configuration whereby the vane 230 is generally perpendicular to the flow of the exhaust gas through the exhaust channel 210. In such embodiments, the backpressure applied to the upstream surface 236 of the vane 230 is approximately equal to the biasing force applied to the downstream surface 238 of the vane 230 by the biasing member 250. Additionally, as shown in the embodiment of FIG. 2B, when the vane 230 is in the closed position, the distal portion 234 of the vane 230 may be contacting or nearly contacting the bottom surface 213 of the exhaust channel 210. Accordingly, the vane 230 entirely or almost entirely prevents flow of the exhaust gas through the exhaust channel 210. Therefore, the flow of the exhaust gas travels entirely or almost entirely through the bypass channel 260.

In the embodiment shown in FIG. 2B, when there is generally complete restriction of the flow of the exhaust gas through the valve system 140, the vehicle 110 may be in a cruise state. For example, the vehicle 110 may be traveling at a constant or nearly constant speed (e.g., the vehicle 110 may be maintaining a generally constant speed without accelerating or by accelerating in marginally small increments). In several examples, when there is generally complete restriction of the flow of the exhaust gas through the valve system 140, the noise level of the exhaust discharge may be quiet. For example, the noise level of the exhaust discharge may be quieter when the vane 230 is in the closed position than when the vane 230 is in the forward open position. This may be preferable for a driver of the vehicle 110 who wants the exhaust system of the vehicle 110 to exhibit the characteristics of a sports exhaust when the vehicle 110 is idling, for example, and the characteristics of a non-sports exhaust when the vehicle 110 is in a cruise state. Therefore, in some embodiments, the valve system 140 may facilitate a quieter environment within the vehicle 110 when the vehicle 110 is cruising. This may allow passengers within the vehicle 110 to converse with each other or to listen to an audio device (e.g., an audio system of the vehicle 110, a phone, an iPod, etc.) when the vehicle 110 is cruising.

In some embodiments, when the vane 230 is in the closed position, the bypass channel 260 receives a flow of exhaust gas at a second pressure (which may be a second bypass pressure). The second pressure across the bypass channel 260 may be greater than the first pressure across the bypass channel 260, which is present when the vane 230 is in the forward open position, as discussed above. Additionally, as discussed above, as the pressure across the bypass channel 260 increases, the flow of the exhaust gas through the bypass channel 260 approaches a saturated flow where an increase in pressure does not correspond to an increase in flow. When the pressure across the bypass channel 260 reaches or substantially reaches the saturated flow condition, any exhaust flow through the bypass channel 260 no longer decreases the backpressure applied to the upstream surface 236 of the vane 230. Accordingly, as the engine load and/or speed of the vehicle 110 further increases, the backpressure applied to the upstream surface 236 of the vane 230 begins to be greater than the biasing force applied to the downstream surface 238 of the vane 230 by the biasing member 250, as shown in FIG. 2C.

Figure 2C:
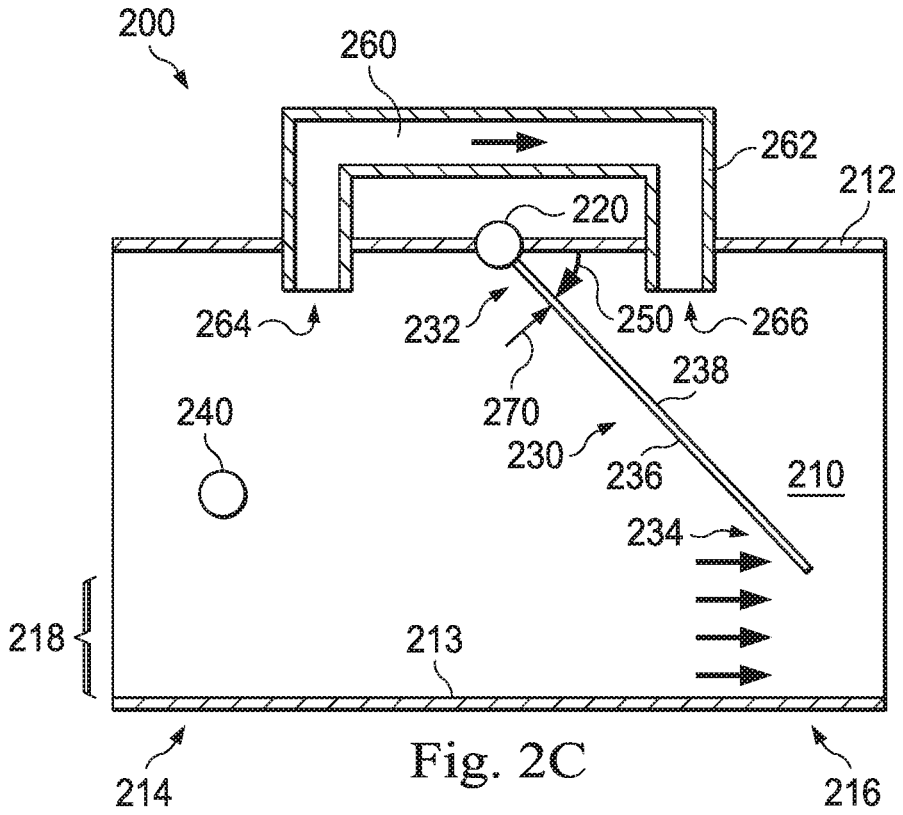
FIG. 2C is a diagrammatic illustration of a system with a vane in a rear open position according to one or more embodiments of the present disclosure.

FIG. 2C is a diagrammatic illustration of the valve system 200 with the vane 230 in a rear open position according to one or more embodiments of the present disclosure. As discussed above, in some embodiments, the vane 230 may be rotatable between a first position, a second position, and a third position. The embodiment of FIG. 2C illustrates the vane 230 in the third position, which may be a rear open position. When the vane 230 is in the rear open position, the distal portion 234 of the vane 230 is downstream of the proximal portion 232 of the vane 230. In such embodiments, the backpressure applied to the upstream surface 236 of the vane 230 is greater than the biasing force applied to the downstream surface 238 of the vane 230 by the biasing member 250. Additionally, as shown in the embodiment of FIG. 2C, when the vane 230 is in the rear open position, the distal portion 234 of the vane 230 is spaced from the bottom surface 213 of the exhaust channel 210. In some embodiments, the distal portion 234 of the vane 230 may be spaced a greater distance from the bottom surface 213 of the exhaust channel 210 when the vane 230 is in the rear open position than when the vane 230 is in the forward open position (see FIG. 2A). In other embodiments, the vane 230 may be spaced the same distance from the bottom surface 213 of the channel when the vane 230 is in the rear open position as when the vane 230 is in the forward open position. In the embodiment shown in FIG. 2C, the vane 230 is angled so as to allow all or substantially all of the exhaust gas to the flow through the exhaust channel 210. Therefore, no or a small amount of exhaust gas flows through the bypass channel 260. Accordingly, when the vane 230 is in the rear open position, there may be no or very little pressure across the bypass channel 260.

In the embodiment shown in FIG. 2C, when there is generally no restriction of the flow of the exhaust gas through the valve system 140, the vehicle 110 may be in an acceleration state, which may be a moderate or full acceleration state. For example, the vehicle 110 may be increasing in speed. In such embodiments, the engine load may be high, and/or the engine speed may be high. In some examples, when the vane 230 is in the rear open position, the engine load may be higher than the engine load when the vane 230 is in the closed position. In several examples, when there is generally no restriction of the flow of the exhaust gas through the valve system 140, the noise level of the exhaust discharge may be loud. For example, the noise level of the exhaust discharge may be louder when the vane 230 is in the rear open position than when the vane 230 is in the forward open position. This may be preferable for a driver of the vehicle 110 who wants the exhaust system of the vehicle 110 to exhibit the characteristics of a sports exhaust when the vehicle 110 is accelerating, for example. Therefore, in some embodiments, the valve system 200 may facilitate sports exhaust characteristics when the vehicle 110 is accelerating. In alternative embodiments, the noise level of the exhaust discharge when the vane 230 is in the rear open position is generally equal to the noise level of the exhaust discharge when the vane 230 is in the forward open position.

In some embodiments, when the vane 230 is in the rear open position, the bypass channel 260 receives a flow of exhaust gas at a third pressure (which may be a third bypass pressure). The third pressure across the bypass channel 260 may be less than the first pressure across the bypass channel 260, which is present when the vane 230 is in the forward open position, as discussed above. Additionally, as discussed above, as the flow of exhaust gas through the valve system 140 increases, the pressure across the bypass channel 260 increases as well until the flow of exhaust gas through the bypass channel 260 reaches a saturated flow. When the flow becomes saturated, any increase in pressure across the bypass channel 260 does not produce a corresponding increase in flow of exhaust gas through the bypass channel 260. Therefore, when the flow through the bypass channel 260 reaches a saturated flow, the backpressure applied to the upstream surface 236 of the vane 230 increases and eventually becomes greater than the force applied to the downstream surface 238 of the vane 230 by the biasing member 250. Accordingly, as the engine load and/or speed of the vehicle 110 further increases, the backpressure applied to the upstream surface 236 of the vane 230 moves the vane 230 from the closed position to the rear open position, as shown in FIG. 2C.

The following discussion will be made with reference to FIGS. 3A-3C. It is to be understood that the discussion of the valve system 200 above with respect to FIGS. 2A-2C and the characteristics with which the valve system 200 performs applies to FIGS. 3A-3C. The differences, in some embodiments, between the valve system 200 and the valve system 300 will be discussed below.

Figure 3A:
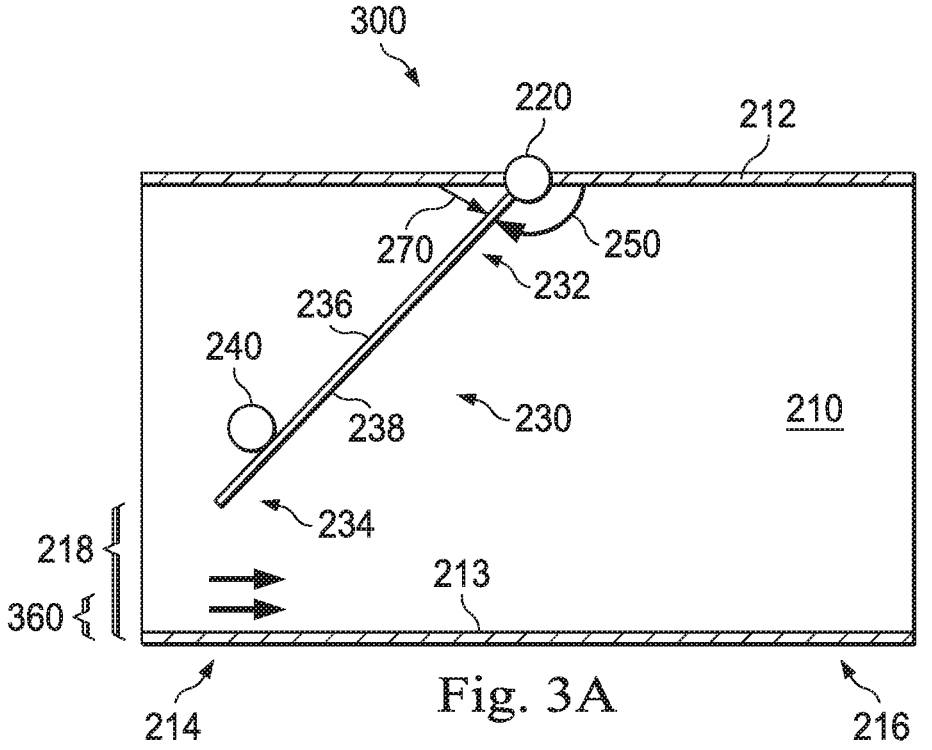
FIG. 3A is a diagrammatic illustration of a system with a vane in a forward open position according to one or more embodiments of the present disclosure.

FIG. 3A is a diagrammatic illustration of a valve system 300 with the vane 230 in the forward open position according to one or more embodiments of the present disclosure. In several embodiments, the valve system 300 may represent the valve system 140 in FIG. 1. In the embodiment shown in FIG. 3A, the valve system 300 includes a bypass channel 360. In several embodiments, the bypass channel 360 is an interior bypass channel. As shown in FIG. 3A, the bypass channel 360 is included as a part of the exhaust channel 210. In some examples, the bypass channel 360 is included in the lower portion 218 of the exhaust channel 210. In several embodiments, the bypass channel 360 functions in a similar manner to the exterior bypass channel 260 discussed above with respect to FIGS. 2A-2C. Accordingly, when the vane 230 is in the forward stop position, as shown in FIG. 3A, the exhaust gas flows through the lower portion 218 of the exhaust channel 210, which includes the bypass channel 360. Therefore, in the forward open position, the exhaust gas may flow through both a lower portion 218 of the exhaust channel 210 and through the bypass channel 360.

Figure 3B:
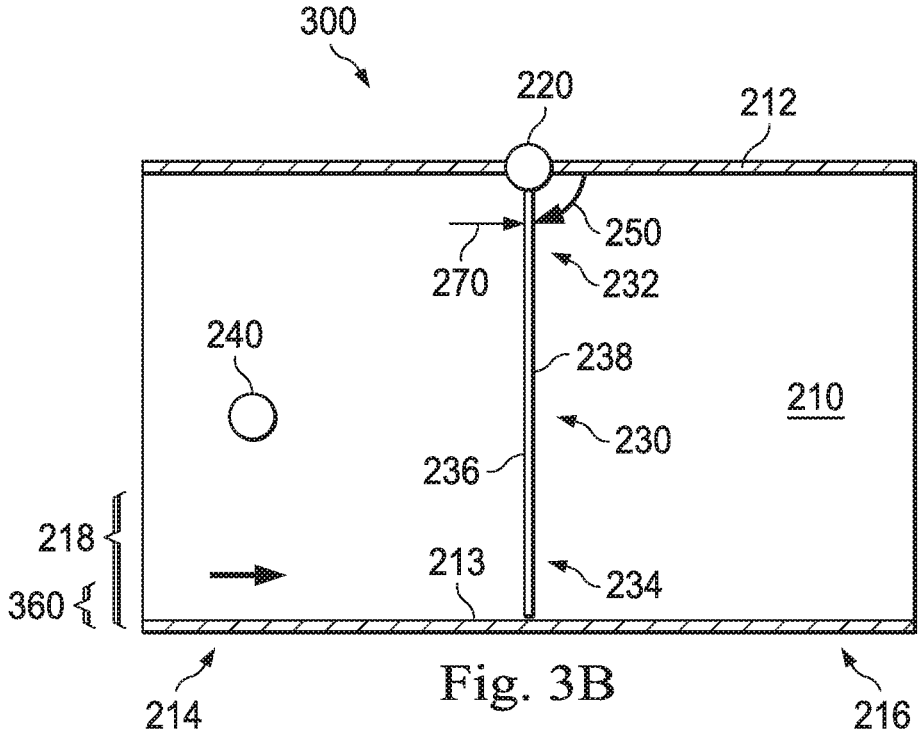
FIG. 3B is a diagrammatic illustration of a system with a vane in a closed position according to one or more embodiments of the present disclosure.

FIG. 3B is a diagrammatic illustration of the valve system 300 with the vane 230 in the closed position according to one or more embodiments of the present disclosure. In the embodiment shown in FIG. 3B, when the vane 230 is in the closed position, the distal portion 234 of the vane 230 may be spaced from the bottom surface 213 of the exhaust channel 210. Accordingly, while the vane 230 entirely or almost entirely prevents flow of the exhaust gas through the exhaust channel 210, the vane 230 is spaced from the bottom surface 213 of the exhaust channel 210 to allow the flow of the exhaust gas to travel entirely or almost entirely through the bypass channel 360. In some embodiments, when the vane 230 is in the closed position, the vane 230 may be spaced from the bottom surface 213 of the exhaust channel 210 by a distance that is less than a distance by which the vane 230 is spaced from the bottom surface 213 when the vane 230 is in the forward open position.

Figure 3C:
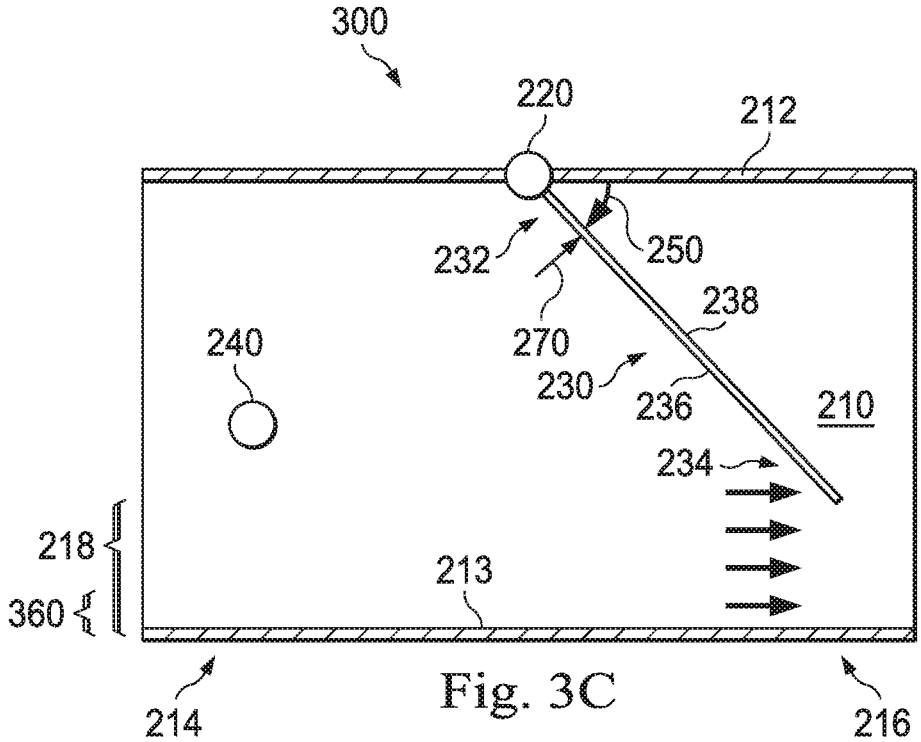
FIG. 3C is a diagrammatic illustration of a system with a vane in a rear open position according to one or more embodiments of the present disclosure.

FIG. 3C is a diagrammatic illustration of the valve system 300 with the vane 230 in the rear open position according to one or more embodiments of the present disclosure. In the embodiment shown in FIG. 3C, when the vane 230 is in the rear open position, the distal portion 234 of the vane 230 may be spaced from the bottom surface 213 of the exhaust channel 210. In some embodiments, the distal portion 234 of the vane 230 may be spaced a greater distance from the bottom surface 213 of the exhaust channel 210 when the vane 230 is in the rear open position than when the vane 230 is in the forward open position (see FIG. 3A). In other embodiments, the vane 230 may be spaced the same distance from the bottom surface 213 of the channel when the vane 230 is in the rear open position as when the vane 230 is in the forward open position. In the embodiment shown in FIG. 2C, the vane 230 is angled so as to allow all or substantially all of the exhaust gas to the flow through the exhaust channel 210. Therefore, the bypass channel 360 may provide no or a small amount of restriction of the exhaust gas flow through the exhaust channel 210.

Figure 4:
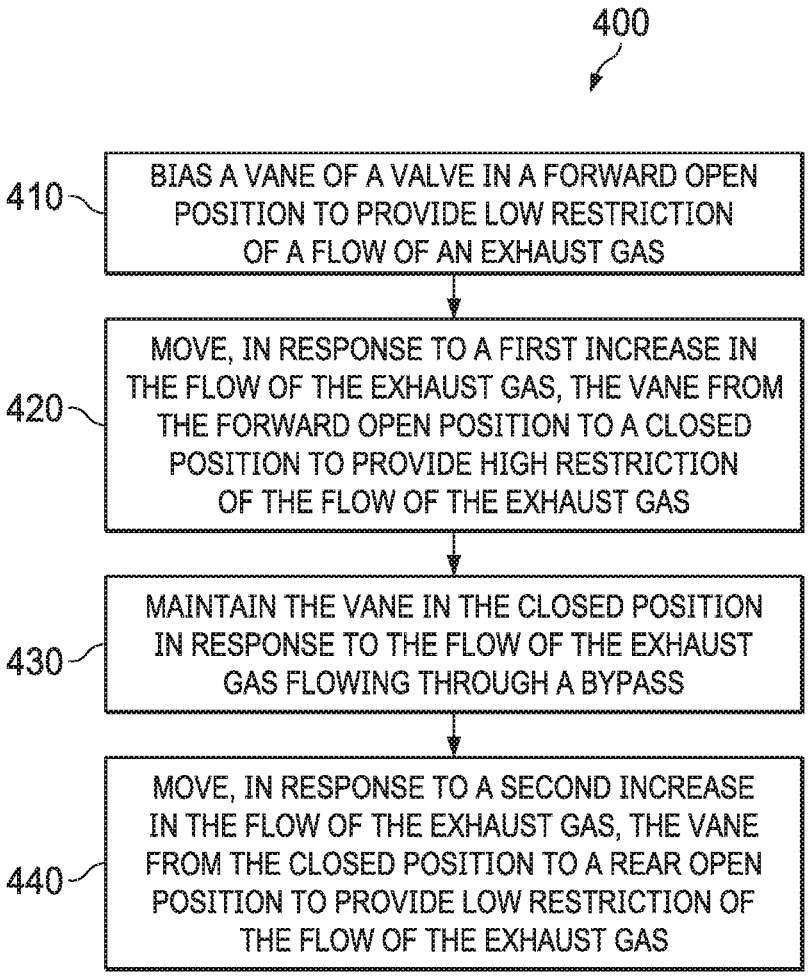
FIG. 4 is a flow chart illustration of a method of operating the system of FIGS. 1, 2A-2C, and 3A-3C according to one or more embodiments of the present disclosure.

FIG. 4 is a flow chart illustration of a method of operating the system of FIGS. 1, 2A-2C, and 3A-3C according to one or more embodiments of the present disclosure. In several embodiments, as discussed above, a biasing member is used to bias the vane in a forward open position to provide low restriction of a flow of an exhaust gas (e.g., flow through an exhaust channel). Because there is low restriction of the flow of the exhaust gas, a noise level of an exhaust discharge may be loud. As the flow of the exhaust gas through the exhaust channel increases (which may occur as the vehicle 110 accelerates from an idling state to a cruising state), the backpressure applied to the vane increases. This increase in flow and corresponding increase in backpressure moves the vane from the forward open position to a closed position. In the closed position, the flow of the exhaust gas through the exhaust channel is generally completely restricted, and a bypass channel becomes the primary flow path for the exhaust gas. This slows the buildup of backpressure on the vane and maintains the vane in the closed position while the vehicle 110 is cruising (e.g., maintaining a generally constant speed with little or no acceleration). Because there is generally complete restriction of the flow of the exhaust gas, a noise level of an exhaust discharge may be quiet (or at least quieter than the noise level when the vane is in the forward open position). As the flow of the exhaust gas through the exhaust channel further increases (which may occur as the vehicle 110 accelerates from the cruising state to a moderate or full acceleration state), the backpressure applied to the vane increases further as well. This increase in flow and corresponding increase in backpressure moves the vane from the closed position to a rear open position. In the rear open position, the flow of the exhaust gas through the exhaust channel is generally not restricted. Because there is generally no restriction of the flow of the exhaust gas, a noise level of an exhaust discharge may be loud (and may be louder than the noise level when the vane is in the forward open position).

In one such embodiment, as illustrated in FIG. 4, the method is generally referred to by the reference numeral 400 and includes at a step 410 biasing a vane of a valve system in a forward open position to provide low restriction of a flow of an exhaust gas. In some embodiments, the biasing member 250 biases the vane 230 in the forward open position so that the distal portion 234 of the vane 230 rests against the stopping member 240. In the forward open position, a force applied by the biasing member 250 to the downstream surface 238 of the vane 230 may be greater than a backpressure applied to the upstream surface 236 of the vane 230. In several embodiments, the backpressure occurs as a result of the flow of the exhaust gas through the exhaust channel 210. In some examples, when the vane 230 is in the forward open position, the exhaust gas flows through the bypass channel 260 as well.

At a step 420 during or after biasing the vane in the forward open position, the vane is moved, in response to a first increase in the flow of the exhaust gas, from the forward open position to a closed position to provide high restriction of the flow of the exhaust gas. In some embodiments, the first increase in the flow of the exhaust gas may occur as a result of an increase in engine speed and/or engine load (e.g., when the vehicle 110 accelerates from an idling position). In some embodiments, when the vane 230 is in the closed position, the distal portion 234 of the vane 230 is close to or in contact with a bottom surface 213 of the exhaust channel 210. In the closed position, the force applied by the biasing member 250 to the downstream surface 238 of the vane 230 may be equal or generally equal to the backpressure applied to the upstream surface 236 of the vane 230. In several embodiments, the backpressure applied to the upstream surface 236 of the vane 230 is greater when the vane 230 is in the closed position than when the vane 230 is in the forward open position. Accordingly, in some examples, when the vane 230 is in the closed position, the exhaust gas flows entirely or almost entirely through the bypass channel 260.

At a step 430, the vane is maintained in the closed position in response to the flow of the exhaust gas flowing through a bypass channel. In several embodiments, the bypass channel is the exterior bypass channel 260 shown in FIGS. 2A-2C. In alternative embodiments, the bypass channel is the interior bypass channel 360 shown in FIGS. 3A-3C. As discussed above with respect to FIG. 2B, the vane 230 may be maintained in the closed position until the flow of exhaust gas through the bypass channel 260 begins to reach a saturated flow condition. When the flow through the bypass channel 260 approaches and/or reaches a saturated flow, the backpressure applied to the upstream surface 236 of the vane 230 may begin to increase so that the backpressure is greater than the force applied by the biasing member 250 to the downstream surface 238 of the vane 230.

At a step 440, the vane is moved, in response to a second increase in the flow of the exhaust gas, from the closed position to a rear open position to provide low restriction of the flow of the exhaust gas. In some embodiments, the second increase in the flow of the exhaust gas may occur as a result of a second increase in engine speed and/or engine load (e.g., when the vehicle 110 accelerates from a cruising state to an acceleration state, which may be a moderate or full acceleration state). After the second increase in the flow of the exhaust gas, the engine speed and/or the engine load may be greater than after the first increase in the flow of the exhaust gas. In some embodiments, when the vane 230 is in the rear open position, the distal portion 234 of the vane 230 is spaced from the bottom surface 213 of the exhaust channel 210. In the rear open position, the force applied by the biasing member 250 to the downstream surface 238 of the vane 230 may be less than the backpressure applied to the upstream surface 236 of the vane 230. Accordingly, in some examples, when the vane 230 is in the closed position, the exhaust gas flows entirely or almost entirely through the exhaust channel 210.

Figure 5:
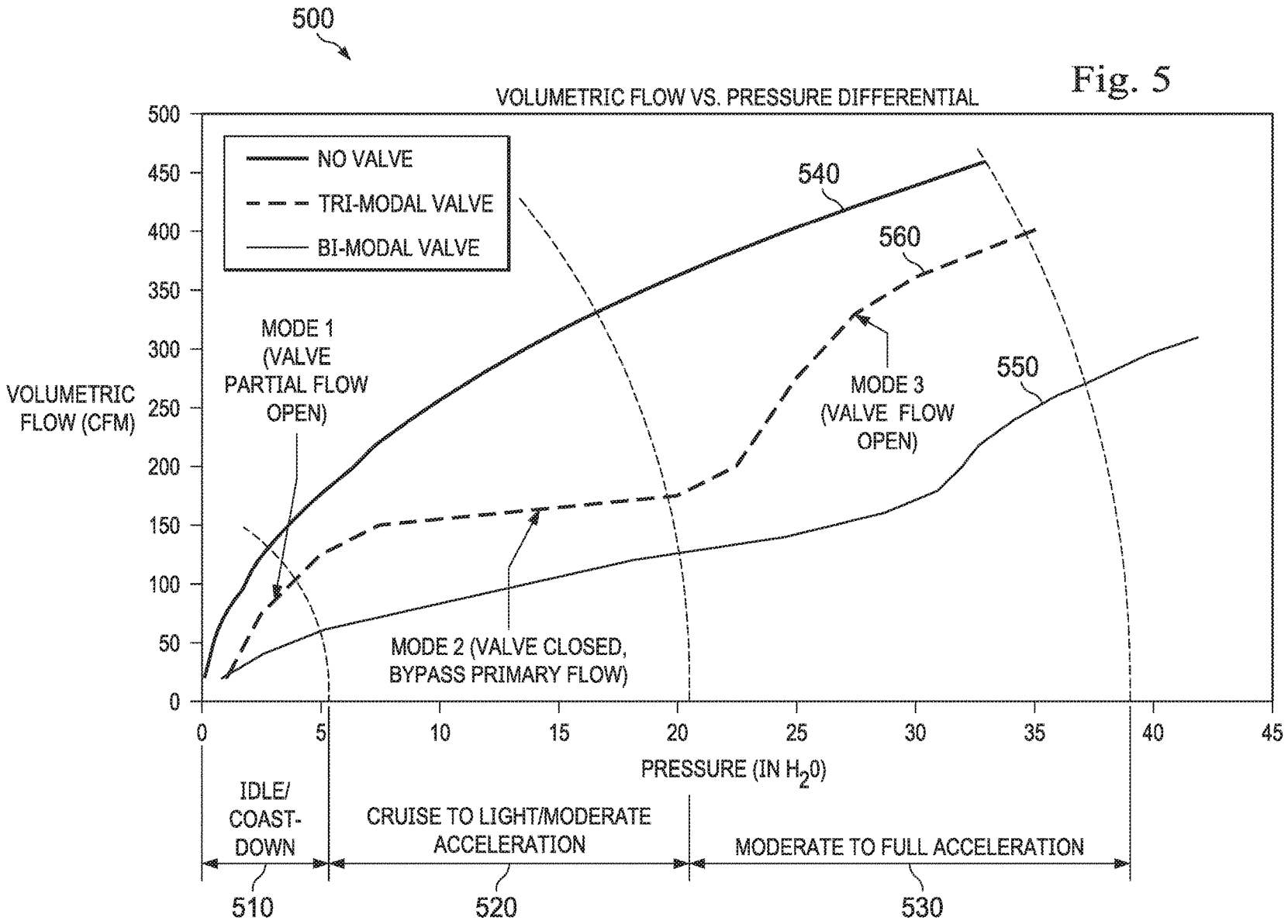
FIG. 5 is a graphical illustration of an operational performance of the system of FIGS. 1, 2A-2C, and 3A-3C according to one or more embodiments of the present disclosure.

FIG. 5 is a graphical illustration of an operational performance of the valve system of FIGS. 1, 2A-2C, and 3A-3C according to one or more embodiments of the present disclosure. As shown in FIG. 5, the graph 500 illustrates three pressure modes: idle/coast-down mode 510 (which may be a first mode), cruise to light/moderate acceleration mode 520 (which may be a second mode), and moderate to full acceleration mode 530 (which may be a third mode). In some embodiments, the idle/coast-down section 510 of the graph 500 may represent a range of pressures (e.g., backpressure applied to the vane 230) when the vane 230 is in the forward open position. In several examples, the cruise to light/moderate acceleration section 520 of the graph 500 may represent a range of pressures when the vane 230 is in the closed position. In further exemplary embodiments, the moderate to full acceleration section 530 of the graph 500 may represent a range of pressures when the vane 230 is in the rear open mode.

As shown in the embodiment of FIG. 5, the volumetric flow 540 for a vehicle without an exhaust valve increases at a generally steady rate as the pressure across the exhaust system of the vehicle increases. Additionally, as also shown in the embodiment of FIG. 5, the volumetric flow 550 for a vehicle with a bi-modal exhaust valve also increases at a generally steady rate as the pressure across the bi-modal exhaust valve increases. Accordingly, a noise level of an exhaust discharge for a vehicle without an exhaust valve and for a vehicle with a bi-modal exhaust valve will steadily increase from a quiet level to a noisy level as the pressure across the exhaust system increases. Therefore, in several embodiments, a vehicle without an exhaust valve and a vehicle with a bi-modal exhaust valve are not able to achieve a reduced noise level during the cruise to light/moderate acceleration mode 520.

In contrast, as shown in the embodiment of FIG. 5, the volumetric flow 560 for a vehicle (e.g., the vehicle 110) with the valve system 140 (which is a tri-modal valve system) increases rapidly during the idle/coast-down mode 510 until the vehicle 110 begins to cruise. Then, the volumetric flow 560 remains generally constant (and may increase slightly) during the cruise to light/moderate acceleration mode 520 until the vehicle 110 begins to fully accelerate. Accordingly, a noise level of an exhaust discharge may decrease when the vehicle 110 is cruising, lightly accelerating, and/or moderately accelerating. In some embodiments, the reduced cabin noise level may occur when the vane 230 of the valve system 140 is in the closed position. In some examples, when the vehicle 110 is idling, the volumetric flow 560 increases. Accordingly, the noise level of the exhaust discharge may increase when the vehicle 110 is idling, for example. In some embodiments, the increased noise level may occur when the vane 230 of the valve system 200 is in the forward open position. Additionally, when the vehicle 110 is fully accelerating (which may occur during the moderate to full acceleration mode), the volumetric flow 560 increases again. Accordingly, the noise level of the exhaust discharge may increase when the vehicle 110 is fully accelerating. In some embodiments, this increased noise level may occur when the vane 230 of the valve system 200 is in the rear open position. In several embodiments, the noise level of the exhaust discharge is louder when the vane 230 is in the rear open position than when the vane 230 is in the forward open position. In other embodiments, the noise level of the exhaust discharge is louder when the vane 230 is in the forward open position than when the vane 230 is in the closed position.

In several embodiments, a computer system typically includes at least hardware capable of executing machine readable instructions, as well as the software for executing acts (typically machine-readable instructions) that produce a desired result. In several embodiments, a computer system may include hybrids of hardware and software, as well as computer sub-systems.

In several embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several embodiments, hardware may include any physical device that is capable of storing machine-readable instructions, such as memory or other data storage devices. In several embodiments, other forms of hardware include hardware sub-systems, including transfer devices such as modems, modem cards, ports, and port cards, for example.

In several embodiments, software includes any machine code stored in any memory medium, such as RAM or ROM, and machine code stored on other devices (such as floppy disks, flash memory, or a CD ROM, for example). In several embodiments, software may include source or object code. In several embodiments, software encompasses any set of instructions capable of being executed on a node such as, for example, on a client machine or server.

In several embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several embodiments, computer readable mediums include, for example, passive data storage, such as a random access memory (RAM) as well as semi-permanent data storage such as a compact disk read only memory (CD-ROM). One or more embodiments of the present disclosure may be embodied in the RAM of a computer to transform a standard computer into a new specific computing machine. In several embodiments, data structures are defined organizations of data that may enable an embodiment of the present disclosure. In an embodiment, a data structure may provide an organization of data, or an organization of executable code.

In several embodiments, any networks and/or one or more portions thereof, may be designed to work on any specific architecture. In an embodiment, one or more portions of any networks may be executed on a single computer, local area networks, client-server networks, wide area networks, internets, hand-held and other portable and wireless devices and networks.

In several embodiments, a database may be any standard or proprietary database software, such as Oracle, Microsoft Access, SyBase, or DBase II, for example. In several embodiments, the database may have fields, records, data, and other database elements that may be associated through database specific software. In several embodiments, data may be mapped. In several embodiments, mapping is the process of associating one data entry with another data entry. In an embodiment, the data contained in the location of a character file can be mapped to a field in a second table. In several embodiments, the physical location of the database is not limiting, and the database may be distributed. In an embodiment, the database may exist remotely from the server, and run on a separate platform. In an embodiment, the database may be accessible across the Internet. In several embodiments, more than one database may be implemented.

In several embodiments, a plurality of instructions stored on a computer readable medium may be executed by one or more processors to cause the one or more processors to carry out or implement in whole or in part the above-described operation of each of the above-described systems, methods, and/or any combination thereof. In several embodiments, such a processor may include one or more of any processor(s) that are part of the components of the above-described systems, and/or any combination thereof, and such a computer readable medium may be distributed among one or more components of the above-described systems. In several embodiments, such a processor may execute the plurality of instructions in connection with a virtual computer system. In several embodiments, such a plurality of instructions may communicate directly with the one or more processors, and/or may interact with one or more operating systems, middleware, firmware, other applications, and/or any combination thereof, to cause the one or more processors to execute the instructions.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously, and/or sequentially. In some embodiments, the steps, processes, and/or procedures may be merged into one or more steps, processes, and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes, and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the borrower not to invoke 35 U.S.C. § 112, paragraph 6 for any limitations of any of the claims herein, except for those in which the claim expressly uses the word "means" together with an associated function.

What is claimed is:

1. A system for regulating performance characteristics of a vehicle, the system comprising:

an engine configured to output an exhaust gas;

an emissions system in fluid communication with the engine, the emissions system configured to clean the exhaust gas; and a valve system in fluid communication with the emissions system, the valve system configured to regulate a flow of the exhaust gas, the valve system comprising:

a vane movable between a forward open position when the vehicle is in an idle state, a closed position when the vehicle is in a cruise state, and a rear open position when the vehicle is in an acceleration state;

a biasing member configured to bias the vane in the forward open position; and a bypass channel configured to provide a bypass flow path for the exhaust gas to control a backpressure on the vane.

2. The system of claim 1, wherein an exhaust discharge has a first noise level when the vane is in the forward open position, a second noise level when the vane is in the closed position, and a third noise level when the vane is in the rear open position.

3. The system of claim 1, wherein in the forward open position, the vane is configured to provide low restriction of the flow of the exhaust gas as the exhaust gas flows through the valve system, and the vane is configured to contact a forward stop.

4. The system of claim 3, wherein the low restriction of the flow of the exhaust gas increases a noise level of an exhaust discharge.

5. The system of claim 1, wherein in the closed position, the vane is configured to provide high restriction of the flow of the exhaust gas as the exhaust gas flows through the valve system.

6. The system of claim 5, wherein the high restriction of the flow of the exhaust gas decreases a noise level of an exhaust discharge.

7. The system of claim 1, wherein in the rear open position, the vane is configured to provide low restriction of the flow of the exhaust gas as the exhaust gas flows through the valve system.

8. The system of claim 7, wherein the low restriction of the flow of the exhaust gas increases a noise level of an exhaust discharge.

9. The system of claim 1, wherein:

when the vane is in the forward open position, the bypass channel receives a first bypass flow at a first bypass pressure;

when the vane is in the closed position, the bypass channel receives a second bypass flow at a second bypass pressure; and when the vane is in the rear open position, the bypass channel receives a third bypass flow at a third bypass pressure.

10. The system of claim 9, wherein:

the first bypass pressure is lower than the second bypass pressure; and the third bypass pressure is lower than the first bypass pressure.

11. A system for regulating performance characteristics of a vehicle, the system comprising:

an engine;

an emissions system; and a valve system configured to regulate a flow of an exhaust gas, the valve system comprising:

a vane movable between:

a forward open position to provide low restriction of the flow of the exhaust gas as the exhaust gas flows through the valve system;

a closed position to provide high restriction of the flow of the exhaust gas as the exhaust gas flows through the valve system; and a rear open position to provide low restriction of the flow of the exhaust gas as the exhaust gas flows through the valve system, wherein restriction of the flow of the exhaust gas when the vane is in the forward open position is greater than restriction of the flow of the exhaust gas when the vane is in the rear open position;

a biasing member configured to bias the vane in the forward open position; and a bypass channel configured to provide a bypass flow path for the exhaust gas to control a backpressure on the vane.

12. The system of claim 11, wherein the valve system further includes a stopping member, wherein the vane contacts the stopping member when in the forward open position.

13. The system of claim 11, wherein:

when the vane is in the forward open position, the valve system provides for a first noise level of an exhaust discharge;

when the vane is in the closed position, the valve system provides for a second noise level of the exhaust discharge; and when the vane is in the rear open position, the valve system provides for a third noise level of the exhaust discharge.

14. The system of claim 13, wherein:

the first noise level is louder than the second noise level; and the third noise level is louder than the first noise level.

15. The system of claim 11, wherein when the vane moves from the forward open position to the closed position, the flow of the exhaust gas through the bypass channel transitions from a first bypass flow to a second bypass flow.

16. A method of regulating performance characteristics of a vehicle, the method comprising:

in response to a flow of an exhaust gas through a valve system being a first flow, biasing a vane of the valve system in a forward open position to provide low restriction of the flow of the exhaust gas through an exhaust channel of the valve system;

in response to the flow of the exhaust gas through the valve system increasing from the first flow to a second flow, moving the vane from the forward open position to a closed position to provide high restriction of the flow of the exhaust gas through the exhaust channel and further provide the flow of the exhaust gas to a bypass channel of the valve system; and in response to the flow of the exhaust gas through the valve system increasing from the second flow to a third flow, moving the vane from the closed position to a rear open position to provide low restriction of the flow of the exhaust gas through the exhaust channel.

17. The method of claim 16, further comprising:

receiving, by the valve system, a first backpressure from the flow of the exhaust gas when the vane is in the forward open position;

receiving, by the valve system, a second backpressure from the flow of the exhaust gas when the vane is in the closed position; and receiving, by the valve system, a third backpressure from the flow of the exhaust gas when the vane is in the rear open position.

18. The method of claim 17, wherein:

the first backpressure is lower than the second backpressure; and the second backpressure is lower than the third backpressure.

19. The method of claim 17, wherein:

moving in response to the first increase in the flow of the exhaust gas comprises moving in response to a transition from the first backpressure to the second backpressure; and moving in response to the second increase in the flow of the exhaust gas comprises moving in response to a transition from the second backpressure to the third backpressure.

20. The method of claim 16, further comprising:

receiving, when the vane is in the forward open position, a first bypass flow through the bypass channel;

receiving, when the vane is in the closed position, a second bypass flow through the bypass channel; and receiving, when the vane is in the rear open position, a third bypass flow through the bypass channel.

* * * * *